US007272244B2

(12) United States Patent
Saporiti et al.

(10) Patent No.: US 7,272,244 B2
(45) Date of Patent: Sep. 18, 2007

(54) METHOD AND UNIT FOR THE PRODUCTION OF IMAGES WITH HIGH RESOLUTION IN JACQUARD FABRIC

(75) Inventors: Alessandro Saporiti, Gallarate (IT); Giovanni Saporiti, Gallarate (IT)

(73) Assignee: Brevitex Etablissement pour l'Exploitation de Brevets Textiles (LI)

( * ) Notice: Subject to any disclaimer, the term of this patent is extended or adjusted under 35 U.S.C. 154(b) by 821 days.

(21) Appl. No.: 10/381,558

(22) PCT Filed: Sep. 19, 2001

(86) PCT No.: PCT/CH01/00566

§ 371 (c)(1),
(2), (4) Date: Jul. 17, 2003

(87) PCT Pub. No.: WO02/27084

PCT Pub. Date: Apr. 4, 2002

(65) Prior Publication Data

US 2004/0027623 A1 Feb. 12, 2004

(30) Foreign Application Priority Data

Sep. 29, 2000 (IT) ..... MI00A2119
Feb. 20, 2001 (CH) ..... 300/01

(51) Int. Cl.

| | |
|---|---|
| ***G06K 9/00*** | (2006.01) |
| ***D03D 49/02*** | (2006.01) |
| ***D03D 47/38*** | (2006.01) |
| ***D03J 1/00*** | (2006.01) |
| ***G06F 19/00*** | (2006.01) |

(52) U.S. Cl. ..... 382/111; 139/1 R; 139/453; 700/131

(58) Field of Classification Search ..... 382/111; 139/1 R, 453; 700/131
See application file for complete search history.

(56) References Cited

U.S. PATENT DOCUMENTS

| | | | | |
|---|---|---|---|---|
| 3,744,035 | A * | 7/1973 | Geirhos et al. | 700/131 |
| 3,786,987 | A * | 1/1974 | Nishikawa et al. | 234/2 |
| 4,078,253 | A * | 3/1978 | Kajiura et al. | 700/131 |
| 4,326,566 | A * | 4/1982 | Lampaert | 139/453 |
| 5,058,174 | A * | 10/1991 | Carroll | 382/111 |
| 5,200,904 | A * | 4/1993 | Tottman | 700/131 |
| 5,829,487 | A * | 11/1998 | Thomas et al. | 139/319 |
| 6,082,412 | A * | 7/2000 | Wildeman et al. | 139/1 R |
| 6,185,475 | B1 * | 2/2001 | Chung | 700/131 |
| 6,390,143 | B1 * | 5/2002 | Speich | 139/1 R |
| 2003/0187538 | A1 * | 10/2003 | Somaia | 700/140 |

FOREIGN PATENT DOCUMENTS

| | | | |
|---|---|---|---|
| DE | 44 38 535 | A | 5/1996 |
| EP | 0 692 562 | A | 9/1999 |
| FR | 2 782 526 | A | 2/2000 |
| WO | WO98 29588 | A | 7/1998 |
| WO | WO 00 60151 | A | 10/2000 |

* cited by examiner

*Primary Examiner*—Andrew W. Johns
*Assistant Examiner*—Anthony Mackowey
(74) *Attorney, Agent, or Firm*—George Pappas

(57) ABSTRACT

The invention relates to a method for the production of images with high resolution jacquard fabric comprising the following steps: colour scanning of an output image to be reproduced on a fabric, video visualisation of said image with the largest number of colours possible with the means employed for said visualisation. The invention is characterised in that the method comprises further steps: selection of a number of base colours to be used for forming said image on said fabric, said number of base colours is related to the number of warp and weft threads which may be used in the loom and which are to be applied in the weaving of said fabric, reducing the original colours of the output image to a number of reduced colours which it is possible to produce by mixing the base colours of the warp and weft threads.

10 Claims, 7 Drawing Sheets

METHOD AND UNIT FOR THE PRODUCTION OF IMAGES WITH HIGH RESOLUTION IN JACQUARD FABRIC

TECHNICAL FIELD

The subject of the present invention is a method for the production of images with high resolution in jacquard fabrics according to the preamble of claim 1 and to a plant for carrying out the method.

BACKGROUND

EP 0 692 562 describes a method for the optical illustration of a fabric consisting of warp and weft threads with a pattern. In this method, the patterns are recorded by a data processing system and displayed on a video screen, the patterns being scanned in from an original. Thereafter, by means of CAD, the warp and weft threads forming the fabric are assigned an intersection diagram, the weaves of which the fabric is to consist being defined. These are known regular weaves, such as linen weaves, satin weaves, twill weaves and basket weaves. Subsequently, the run of the warp and weft threads is determined, the thread-specific parameters and fabric parameters being taken into account. In light of the dynamic behavior and run of warp and weft, the predetermined run of the warp and weft threads is corrected. This corrected warp/weft thread run is illustrated by means of an output unit, for example by means of a video screen or printer. After the correction, various colors are assigned to the individual warp and weft threads.

It is considered a disadvantage that the colors are selected as a function of the colors capable of being illustrated in the output unit, for which purpose a person skilled in the art with experience of weaves is necessary. The output unit is a video screen or a printer which operate on the basis of the ground colors (RGB) and with additive color mixing. It is known, however, that an exact reproduction of an illustration cannot be achieved in the fabric in the ground colors by means of textile weft threads. Since the colors capable of being illustrated by the output unit also contain mixed colors, threads with such mixed colors have to be provided.

DE 44 38 535 discloses a method for the jacquard weaving of a colored cloth. In this method, an image copy to be woven is broken down by means of the screen method known from printing technology. In this method, an original is transferred into a computer by scanning and is displayed on the video screen, a very large number of color shades being present. Subsequently, the colors are reduced to an illustratable or a desired number of colors. Finally, this number of colors is broken down into screen dots having the colors red, yellow and blue and also black and white, the screen dot having the size of a weavable point. After the color breakdown, the weaving program is set up by means of computer technology, each screen dot corresponding to a weaving point. These weaving points are tied off according to the classic jacquard method, that is to say regular weaves with repeat repetitions are used.

The known method has substantial disadvantages. To carry out the method, it is absolutely necessary to have an experienced person skilled in the art with experience of weaves. To be precise, it has become clear that, in the case of woven colored image copies in the colors yellow, red and blue, the color mix is deficient, that is to say they do not have all the color shades of the original. As a rule, corrections are necessary in order to improve the woven image copy.

However, corrections of this kind can be carried out only by an experienced person skilled in the art with experience of weaves. In the color breakdown for reprography, it is to be assumed that a color mix occurs in the region between the print colors during the printing operation. In other words, the printed color dots are not clearly delimited, but, instead, the print colors of the adjacent color dots flow partially one into the other in the edge region. In the known method, the illustration is broken down into screen dots which form a weaving point with clear delimitation. The mixing effects are to be generated as a result of the low resolution of the human eye.

It is therefore known that the introduction of jacquard weaving machines has made it possible to produce differently worked patterns, but the production times for more complex patterns are very long and the work to be carried out is extremely complicated. The introduction of the CAD systems in the area of jacquard weaving has led to a considerable simplification of the necessary work and at the same time has reduced the possibility of error during the planning and production of different thread interlacings for the purpose of obtaining various effects. The CAD systems nevertheless also force the workers to carry out special additional work on the images in order then to produce on the final fabric a structure which is as similar as possible to the initial image to be reproduced on the fabric.

In actual fact, the work for preparing the images and their respective treatment, quite apart from the weaving system which is used later, take place as set out below:

First, a color scanning of any desired initial image is carried out (the initial image may be of any desired type, without any restriction); scanning may take place with the aid of a scanner or by means of any other reading system.

The initial image read in this way is visualized by video by means of an appreciable number of colors. Said number of colors is closely related to the performance of the hardware system used and consequently to the configuration of the latter.

In professional configurations, an image with millions of image colors can be read and visualized by video. In actual fact, this is primarily a theoretical performance, since the possibility of visualization of this kind is very rare: normally, images coming from the scanner have thousands of image colors which are selected automatically, during the reading operation, from a spectrum consisting of millions of colors. It is necessary, however, to ensure that each image read by the scanner contains a specific color palette or, put better, a color palette which contains the colors of the image itself in a specific way.

At this point, said image undergoes a first operation for reducing the number of existing image colors, that is to say the initial colors of the initial image. The processes of color reduction may be carried out by means of different methods, such as by the use of special mathematic algorithms which, to be precise, vary on the basis of the way in which the colors are eliminated and/or are replaced by other colors within the image.

In any event, quite apart from the nature of the reduction used and, consequently, of the mathematic algorithm used, the initial image having a large number of initial colors is brought, for example, to 256 reduced colors. This is a step which takes place by virtue of the fact that the images which are subsequently processed by CAD for jacquard textiles do not require a large number of colors, and, as a rule, it is assumed that 256 colors are sufficient for the final objective and for the treatment of the image itself, specifically on the basis of the respective conversion to a pattern for jacquard textiles.

The image treated in this way (reduced in terms of the number of colors), is subsequently transferred into the jacquard CAD system in which all the operations are coordinated which make it possible to convert the image itself into a pattern for jacquard textiles. One of the first steps in this respect is a further reduction of the remaining, already reduced colors. In fact, the number of existing colors is reduced in the image on the basis of the type of fabric and on the basis of the effects to be achieved. Normally, in a fabric pattern, each individual color illustrates a specific type of interlacing and, consequently, a specific type of final effect on the fabric.

At this point, the following steps are linked to the additional work on the available image. On the other hand, the image then available has passed through a considerable series of steps in terms of the reduction, as regards the number of colors and consequently also as regards the information obtained from the image, and, consequently, as soon as the number of selected colors is reached, an image is available which necessarily has to undergo the additional work, so that it is as far as possible similar to the initial image.

The time necessary for the "additional work" on the images is in close interrelationship with the complexity of the pattern. This clearly and markedly implies that, even today, despite the use of highly developed systems, the complex patterns require long times for the complete and final additional work. At the present time, therefore, there is no mathematic algorithm available which makes it possible to convert automatically an image which is read by a scanner (and which is consequently rich in information in terms of the number of existing colors and the nuances, etc.) and at the same time to achieve the exact reproduction of the initial image, without the additional work having to be carried out.

In practice, the different steps described above, which are performed with the purpose of reducing the number of colors present in the read initial image, do not make it possible to maintain, unchanged, the nuances, color shades and different color variations which the image initially has. All this takes place to the disadvantage of the image processing times, but also to the disadvantage of the quality of the final fabric; by "quality" is meant in this case the difference existing between the initial image at the time of reading and the converted image reproduced on the jacquard fabric.

Of course, the number of colors which the image to be reproduced on the jacquard fabric possesses at most may be limited, specifically also by the maximum number of colors of the weft thread which are capable of being used in the weaving machine. Normally, what can be achieved, at least at the present time, in textile weaving machines is that these use up to a maximum of 12 weft thread colors, and therefore the number of reproducible colors is necessarily limited.

SUMMARY OF THE INVENTION

The main object of the present invention is to implement a method for the production of images in jacquard fabrics, which makes it possible to maintain the extremely high resolution of an image, without additional work on the image itself having to be carried out in this case.

Within the scope of this object, one aim of the present invention is to implement a method for the production of images in jacquard fabrics, which makes it possible to leave essentially unchanged the graphic resolution of the initial image, a particular operation to be precise, the reduction of the colors of the initial image, being carried out, and the additional work on the image being dispensed with.

A further aim of the present invention is to implement a method for the production of images in jacquard fabrics, which makes it possible to accelerate to an extreme extent the times for reproducing the image in the fabric.

A further aim of the present invention is to implement a method for the production of images in jacquard fabrics, which is capable of reproducing as exactly as possible the nuances and the whole of the image colors present in the initial image.

Last but not least, an aim of the present invention is to implement a method for production of images in jacquard fabrics, which is distinguished by high reliability, relatively simple implementation and low costs.

The subject and all the aims mentioned, which are set out more clearly below, are achieved by means of a method for the production of images with high resolution in jacquard fabrics.

Further advantageous refinements of the invention may be gathered, in particular, from the exemplary embodiments.

It is particularly advantageous if the breakdown of the reduced image colors takes place with the inclusion of a predetermined warp/weft thread ratio, and that the weaving program provides for the use of irregular weaves without weave repeat repetition. The weaving program provides for the use of irregular weaves without repeat repetition.

The electronic image processing by means of the system results in a high resolution of the illustration or image copy to be woven. By the warp/weft thread ratio being included in the splitting of the image colors into the basic colors, this resolution advantageously takes place largely free of loss and there is consequently a largely true-to-original reproduction of the illustration in the fabric. By the use of irregular weaves without repeat repetition, image dots which are mixed into the figure of a colored illustration are generated, as in printing. It is essential, in this case, that the image dots can be generated directly by the computer according to the original, without manual correction by a person skilled in the art with experience of weaves. After the color breakdown, including the warp/weft thread ratio, a weavable data format is prepared in a CAD system from the illustration to be woven and is delivered to a weaving machine.

It is advantageous if the warp/weft thread ratio is 2:1. With this ratio, the conditions during weaving, with twenty-eight weft threads and fifty-six warp threads per cm, can be adhered to exactly.

By use of thread groups of at least two basic colors, it becomes possible to generate an irregular weave without repeat repetition.

By the illustration of the initial image to be woven being reduced to a maximum of 256 colors, the image copy can be woven by means of weft threads in only four basic colors. This results in a simplification of the weaving machine.

The use of weft threads with the basic colors black and white has the advantage that, on the one hand, black/white illustrations with high resolution can be woven, and, on the other hand, the contrasts in colored image copies with the basic colors red, green, blue and yellow can be reproduced perfectly.

The free selection of the basic colors allows an unrestricted combination and, in particular, exact adaptation of the woven image copy to the illustration of the initial image.

The insertion of weft thread groups in a uniform order has the advantage that the weaving program to be prepared is simpler.

It is advantageous if the weaving program provides for the combination of regions having irregular weaves with regular weaves with repeat repetition, because the configuration of fabrics is thereby broadened substantially.

BRIEF DESCRIPTION OF THE DRAWINGS

Exemplary embodiments of the invention are explained in more detail below with reference to the accompanying drawings in which.

DETAILED DESCRIPTION OF THE INVENTION

Figure 1:
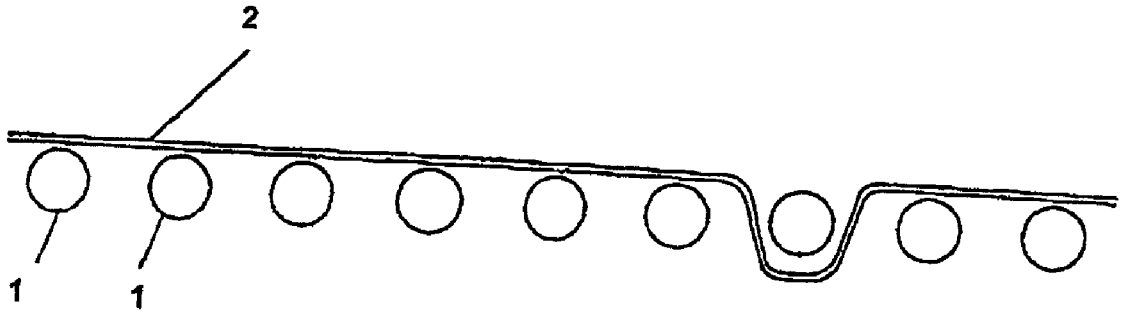
FIG. 1 shows the diagrammatic run of a weft thread through warp threads of a jacquard fabric which are illustrated in section.

The method according to the invention comprises an initial phase of color scanning of any desired image which may be of any type, without any restriction in terms of typology and of dimensions.

The image read in this way is visualized by video by means of an appreciable number of colors: said number of colors is in close interrelationship with the performance of the hardware system used and, consequently, with the configuration of the latter.

At this point, the execution of a selection of the number of necessary colors is commenced, specifically directly from the video image or by a selection of the colors within the total spectrum of the visible field of colors, an infinite selection of color shades and variants consequently being offered.

In practice, the worker selects the number of basic colors of the weft and of the warp which he would like to use during weaving, that is to say the number of basic colors corresponding to the number of warp and weft threads which the weaving machine can use. According to the invention, the method provides for reducing the initial colors of the initial image within the maximum possible colors by means of the selected basic colors.

Essentially, a series of virtually infinite different color shades occurs in the initial image; all these color shades are obtained by means of the reproduction of the initial color by means of the combination of one or more threads of different colors, thus leading to the visualization of the desired color.

The result of the combination of one or more threads having basic colors selected by the worker is the reduced color of the reduced initial image which is prepared by means of a scanner.

A method for converting the pixels of the reduced image into the selected basic colors is called the "dithering" method. This method makes it possible to reproduce the extremely large number of image colors present in the initial image by means of a comparatively very small number of colors, without a reworking of the image having to be carried out. In fact, with this method, no details of the image are lost, which, by contrast, are lost in known techniques in which the reduction of the image colors to a highly accurate number of weft colors takes place, but without a reproduction of the unavoidably absent colors being carried out.

The interaction of the selected basic colors makes it possible to visualize all the other colors which are required for the image, so that it coincides with the initial image. The nuances of the image derive from the quantity of pixels of the color which is selected with greater or lesser intensity, the starting point being the basic colors which were initially selected by the worker.

The color shades are obtained by mixing the pixels of the basic colors which are selected with a greater or lesser intensity according to the color shades to be reproduced. If, for example, by virtue of the reduction in the number of colors, the following basic colors black, white, red, yellow, green and blue are selected, then a series of virtually infinite different color shades (red, gray, green, yellow shades, etc.) are achieved in the reduced initial image. All these color shades are obtained by the combination of threads of different basic colors (consequently, the color shades are simulated, since a weft or warp thread having this particular color shade is not necessarily inserted into the weaving machine) which (selected from the colors intended for carrying out the reduction) lead to the visualization of the desired color.

If, for example, the color straw yellow is to be simulated, the yellow and white threads are combined, thus resulting visually in the color straw yellow. Of course, the color shades of straw yellow which are to be achieved are diverse, and, consequently, processing must be carried out with regard to the quantity of the basic colors white and yellow which are combined so that all these color shades are obtained.

In light of the fact that the colors are always obtained by the interlacing of two types of threads which are arranged at right angles to one another, one type being the warp threads, the other type the weft threads, normally the weft thread having a specific color is interlaced with the warp threads, the final result being a particular color on the upper and the lower face of the fabric.

FIG. 1 illustrates the warp threads 1, illustrated in section, and a weft thread 2 which executes the crossover through a warp thread. The final color of the fabric is consequently obtained from the respective color of the weft thread 2, since this thread is worked over the warp thread (the weft thread portion is consequently yellow and the face of the fabric will be yellow). The situation illustrated is a standard situation in which an attempt is made to obtain a pure color on the fabric.

In the event that, by contrast, particular nuances of yellow are to be achieved, an attempt must be made to work the yellow weft thread 2 on the upper face of the fabric (consequently, above the warp threads 1), specifically together with a further weft thread 2' or with a plurality of weft threads, in order to obtain the desired nuances.

Figure 2:
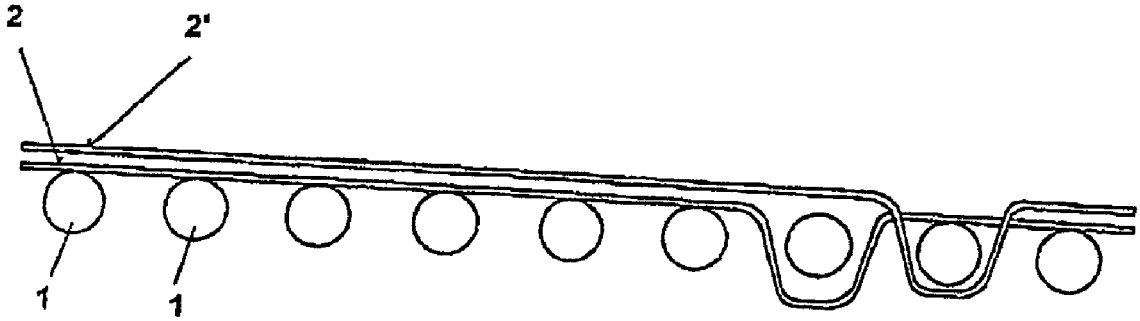
FIG. 2 shows the diagrammatic run of two weft threads through the warp threads of a jacquard fabric which are illustrated in section.

FIG. 2 illustrates the situation where the yellow weft thread runs past, together with the white weft thread 2', above the warp threads 1; a light medium yellow is thereby achieved. The quantity of the colors yellow and white can then be determined from the different nuances. By "quantity" it is meant in this case the number of warp threads 1 which are covered by the weft thread 2, 2'. In FIG. 2, it can be seen, for example, that the yellow weft thread 2 remains above the five warp threads 1, while the white weft thread 2' remains above the six warp threads. This means that, in this case, the yellow is very light (more white than yellow).

There is no limitation as regards the quantity of the colors to be used (the weft thread or the warp threads may also be interlaced to form a single warp thread) and as regards the number of weft threads which can be used in order to generate different color shades. In fact there are colors which can be created by combination of more than two threads of different basic colors.

The "dithering" method thus makes it possible to split each color into various dots of selected basic colors. It may therefore happen that, for some colors, it is necessary to use all the basic colors which were initially selected by the worker. This is due to the fact that the final colors of the fabric are not achieved by the direct presence of the weft thread having the specific color, but by the combination (in different quantities) of the selected basic colors: consequently, the colors are simulated and are not actually present. It therefore seems obvious that, in a situation of this kind, no reworking of the image is necessary, since the latter is converted into a fabric pattern, without initial information being lost at the same time.

Moreover, by means of the method according to the present invention, the initial image is treated as though it were already a pattern for jacquard textiles and not merely a graphic file. In fact, each initial image is composed of square pixels, whereas the equivalent textile images consist of right angles with dimensions which are different on the basis of the parameters to be used. The situation which arises as a result of the conversion of an image consisting of square pixels into a textile pattern is one where the image necessarily experiences changes in shape and consequently the final textile pattern no longer has a perfect graphic resolution. The method according to the invention makes it possible to change the dimensions of the initial pixels, so that the latter coincide with the rectangle on the drawing paper used for the textile pattern, or vice versa.

Consequently, does not experience any change in shape during the transition to the textile pattern and with the transition from pixel to drawing paper and therefore also does not require any reworking.

In practice, it was ascertained how the method according to the invention completely achieves the set object or fulfills the aims set in the introduction, since it makes it possible to reduce the number of colors of an image, without information on the image itself being lost at the same time, and without the need to carry out on the image itself reworking which unavoidably entails long processing times.

The method conceived in this way may undergo numerous and different modifications which are all within the scope of the concept of the invention. Thus, the method can be used, for example, for any type of warp thread, so that even micrometric particulars of the initial image are made possible. Moreover, all details may be replaced by other technically equivalent elements. In practice, the materials used, insofar as they are compatible with the respective application, and also the dimensions may be of any desired type according to the requirements and to the state of the art.

A more detailed description of various exemplary embodiments follows.

Figure 3:
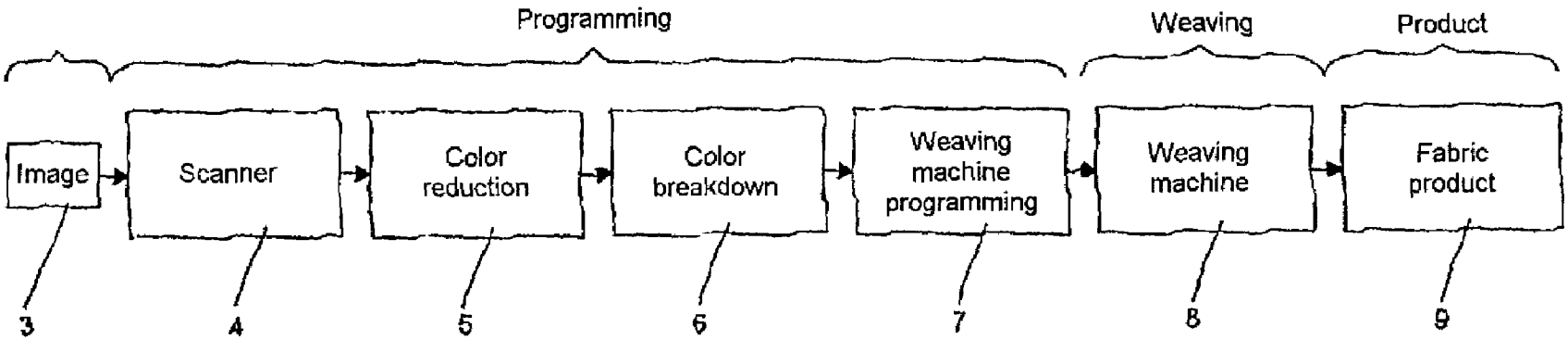
FIG. 3 shows a block diagram of one version of the programming system according to the invention for the production of a jacquard fabric.

FIG. 3 shows a version of the invention in question here. The programming system starts from an original in the form of an initial image 3 and comprises the program steps of scanning 4, color reduction 5, color breakdown 6 and weaving program 7 which is worked through in a weaving machine 8 to produce the fabric 9 having the desired final image.

In the first step, an image having, for example, approximately 1.6 million colors is scanned and is illustrated on a video screen. Depending on the resolving capacity of the scanner and of the video screen, the illustration of the image which appears on the video screen usually has a few thousand colors or color shades.

In a second step, the colors of this image are reduced to an illustratable amount, for example, to 256 colors. In this color reduction, various colors are lost or are replaced by other colors within the color spectrum.

The third step comprises a plurality of substeps. First, a predetermined number of basic colors are selected for the warp and weft threads which are used during weaving. Advantageously, weft threads having the basic colors red, green, blue, yellow, black and white are selected.

Figure 4:
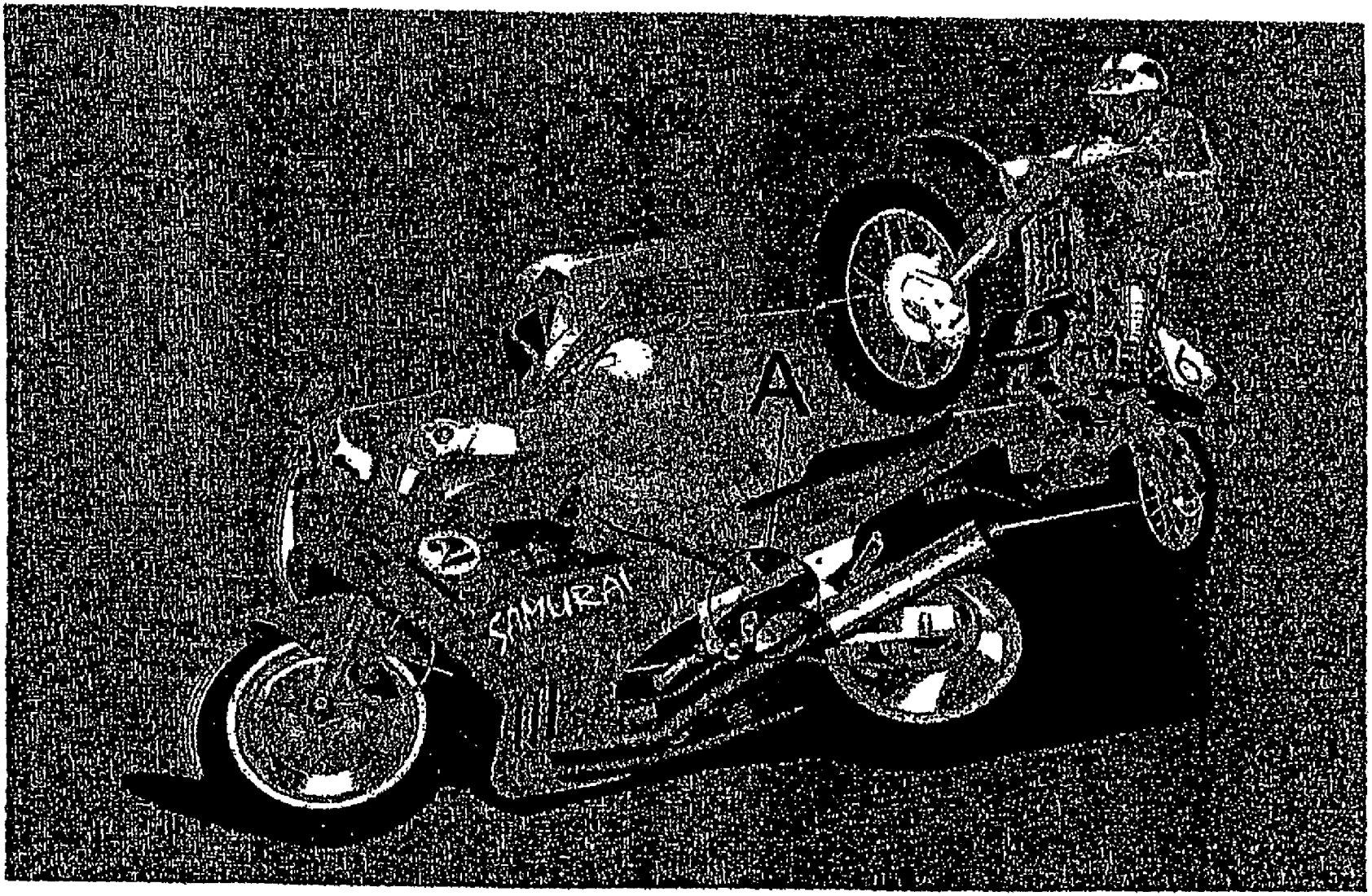
FIG. 4 shows a copy of an initial imager serving as an original, of an image copy to be woven.
Figure 5:
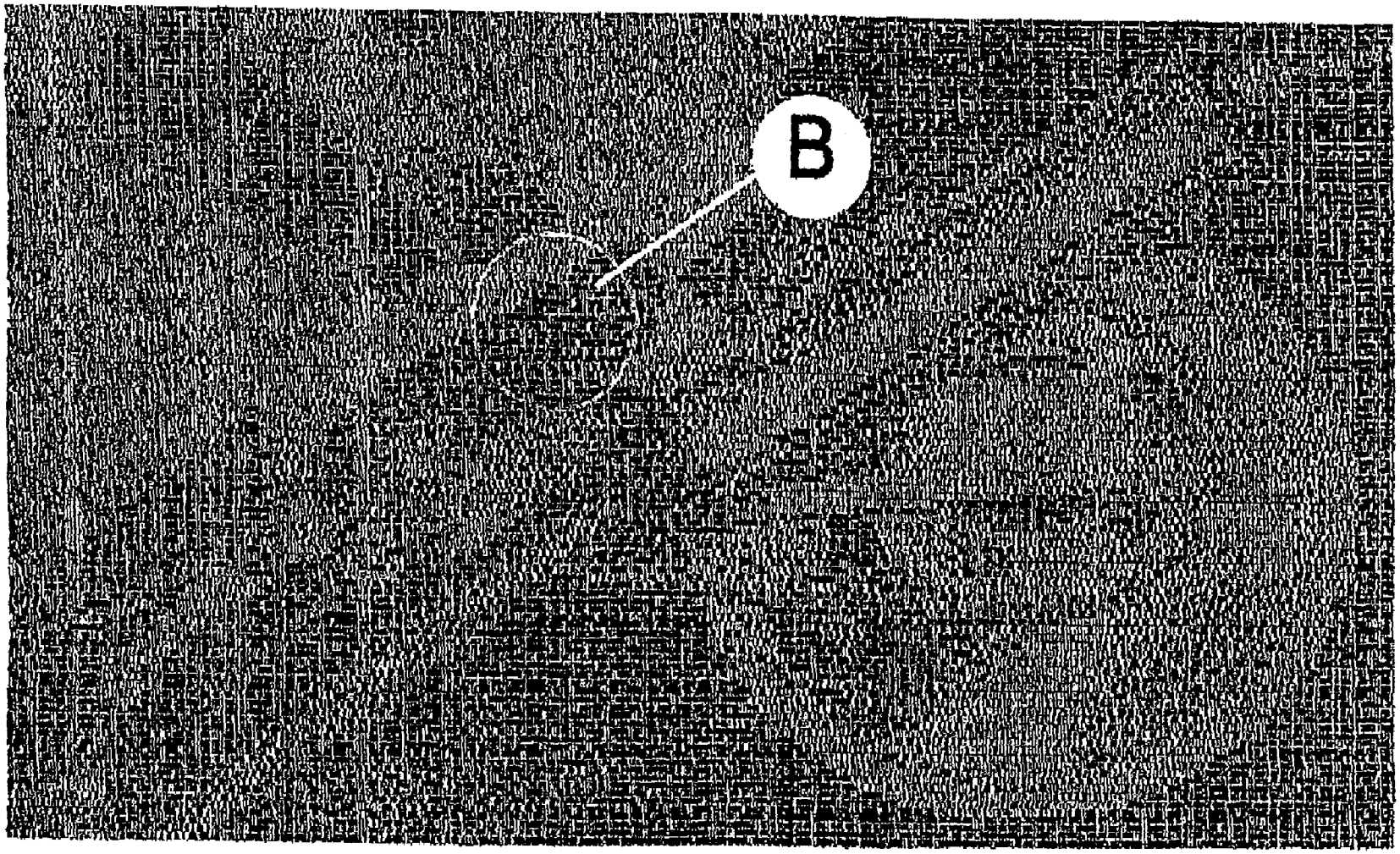
FIG. 5 shows an enlarged detail A of the original according to FIG. 4 on a larger scale after the color breakdown of the illustration into selected basic colors.
Figure 6:
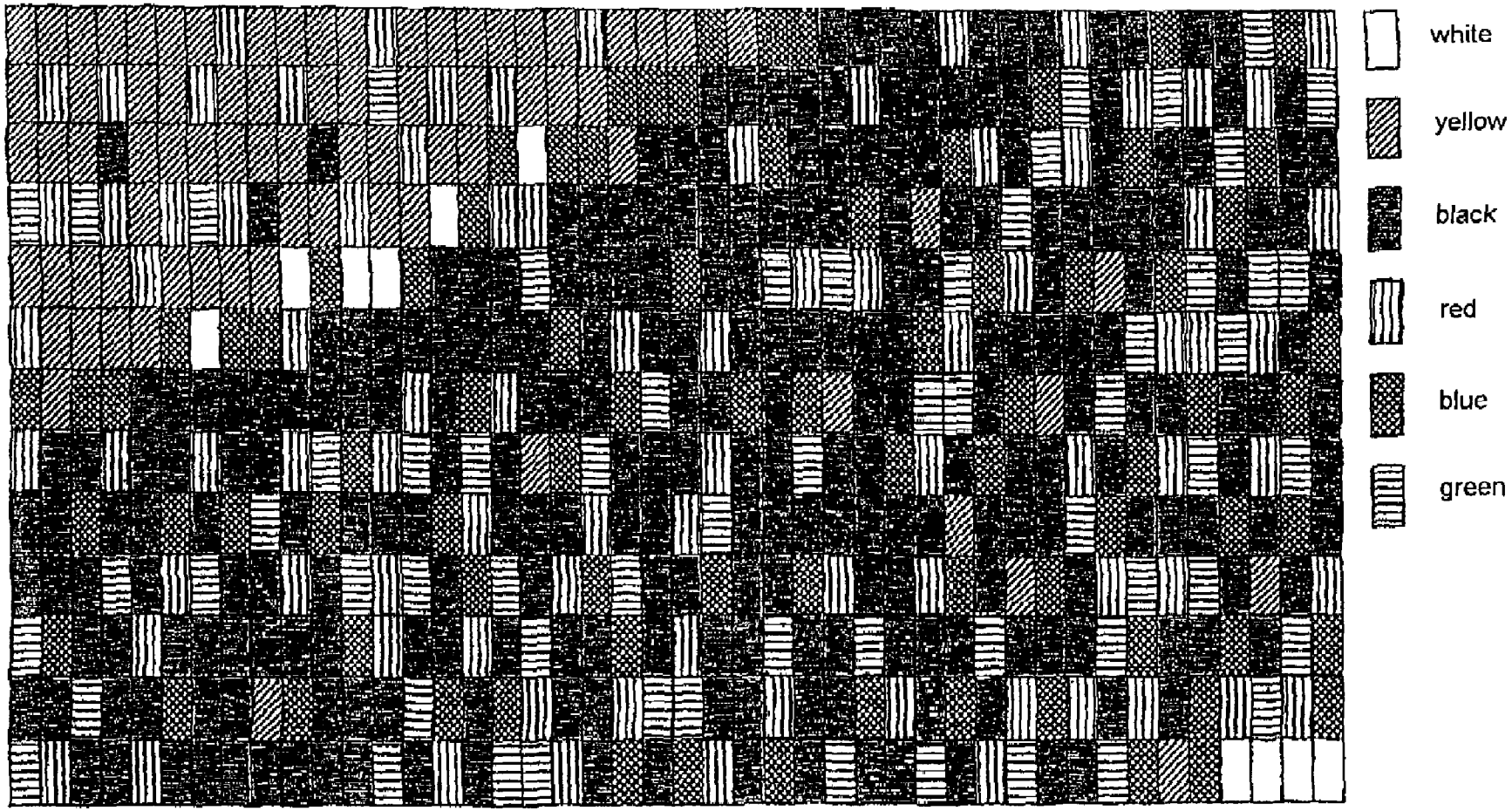
FIG. 6 shows an enlarged detail B in FIG. 5.

Subsequently, the 256 reduced colors are broken down into the basic colors. This breakdown takes place automatically and generates a figure which shows the weaving pattern (FIGS. 4 and 5).

During the electronic image processing, colors are illustrated by means of pixels. The image colors are illustrated as color cells, each color cell being represented by a representative color. Nuances of the image colors are obtained from the quantity of pixels of the color with a differing color depth which is selected. In the color reduction, the colors are replaced by representatives of the color cells into which the color falls. However, not every pixel is imaged onto the representative of the color cell, but, instead, is transferred on to one of the adjacent image colors.

Finally, a splitting of the image colors takes place, said transfer being carried out. By means of this transfer, there is a division, on the one hand, of the image colors into image dots of the basic colors and, on the other hand, of the color shades of the image colors in terms of their color depth into image dots of the basic colors, which are combined in order to generate the color shades, for example red and white for light red. The image dots are formed in each case by a weft thread which has a basic color and which crosses a weft thread above on the visible side of the fabric. During this splitting, a warp/weft thread ratio of 2:1 is included, so that the illustration to be woven is formed by the rectangular color dots, illustrated in FIG. 5, forming the basis for the weaving program to be set up.

Figure 7:
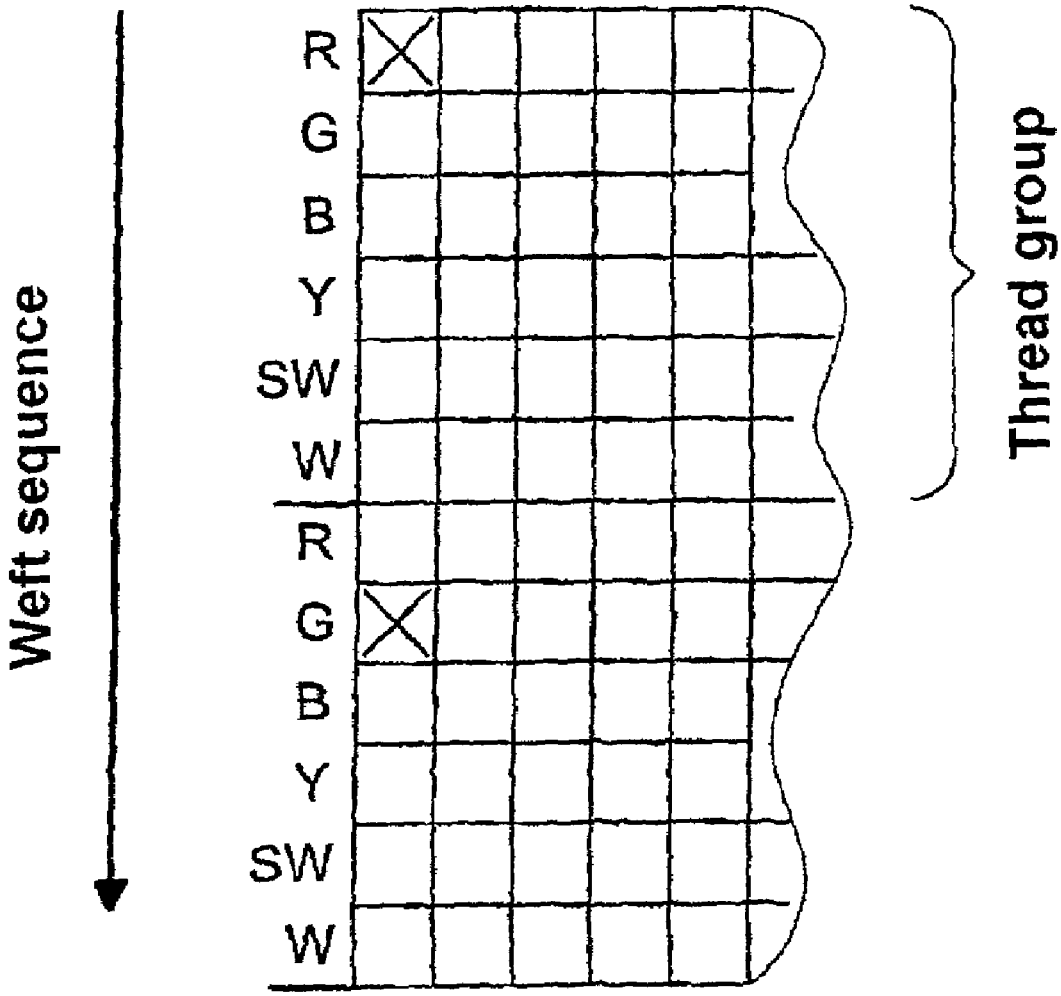
FIG. 7 shows an illustration of the weft sequence for the fabric.
Figure 10:
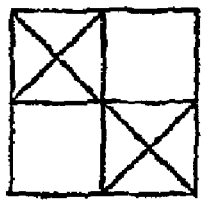
FIG. 10 shows a weave point design paper for a regular weave.
Figure 8:
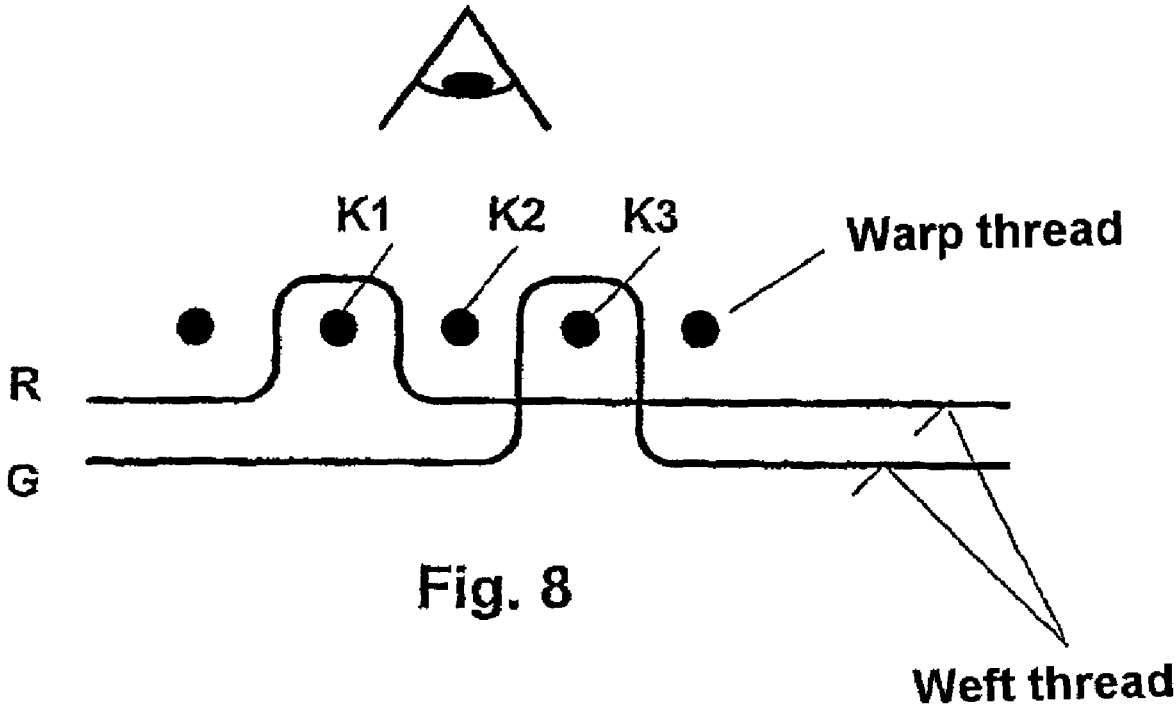
FIG. 8 shows a sectional diagram of a fabric with an irregular weave.
Figure 9:
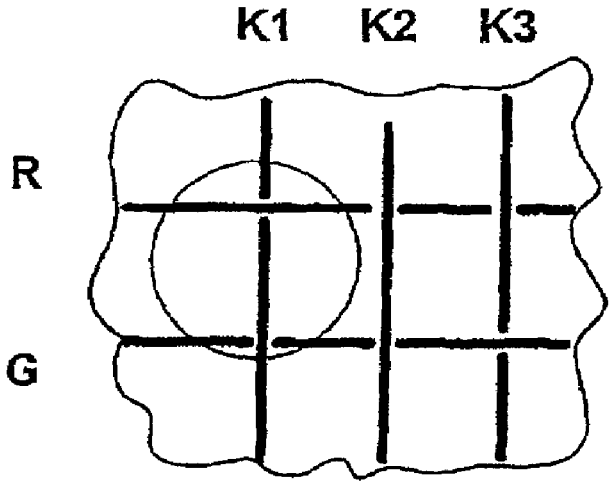
FIG. 9 shows a top view of the fabric according to FIG. 8.

In the fourth step, the programming of the image copy to be woven is carried out on a computer. Reference is made to FIGS. 7 to 10. By means of the weaving program, the insertion of the weft threads and the movement of the warp threads (upstroke and downstroke) are regulated. As shown in FIG. 7, six weft threads having the basic colors red, green, blue, yellow, black and white are used. The weft threads are inserted in this order as a thread group in a weft line and form a color cell. The weft threads are tied off by means of the warp threads. For this purpose, the weaving program provides an irregular weave without repeat repetitions and regular weaves with repeat repetitions. The irregular weave takes place according to the color dots generated during the breakdown, in such a way that, for example, the red weft thread R of the thread group is visible as a red color dot on the visible side of the fabric and the remaining weft threads float on the back side. The same applies to the generation of a green color dot, the green weft thread G being visible. This is illustrated in FIGS. 8 and 9.

As described above, during the color breakdown, color dots with color nuances and a different color depth are obtained. For color dots of this kind, the weaving program provides for a color mix which may take place, for example, by means of at least two weft threads having a different basic color. The weaving program provides further possibilities, for example with floating weft threads.

The invention claimed is:

1. A method for the production of images with high resolution in jacquard fabrics, which comprises the following phases:

color scanning of an initial image which is to be reproduced on a fabric;

video visualization of the initial image by means of the largest possible number of colors, which is possible in conjunction with the means used for said video visualization, characterized in that the method also comprises, furthermore, the following phases:

selection of a number of basic colors which are to be used for reproducing the initial image on the fabric; in this case, the number of basic colors is in interrelationship with the number of warp and weft threads which can be used for the weaving machine and which are used for weaving the fabric;

reduction of the initial colors of the initial image to a number of reduced colors which are possible by the mixing of the basic colors of the warp and weft threads, wherein the mixes of the selected basic colors are pixel mixes, the pixels being formed in each case by the intersection of at least one warp thread and one weft thread, the breakdown of the reduced colors takes place with the inclusion of a predetermined warp/weft thread ratio, and in that a weaving program provides for the use of irregular weaves without weave repeat repetition, and the warp/weft thread ratio is 2:1.

2. The method as claimed in claim 1, characterized in that the conversion of the reduced colors of the reduced initial image to the number of selected basic colors involves a dithering method.

3. The method as claimed in claim 1, characterized in that the nuances of the reduced initial image are reproduced by means of the number of pixels in the selected basic colors.

4. The method as claimed in claim 1, characterized in that the initial colors of the initial image are reduced to a maximum of 256 colors.

5. The method as claimed in claim 1, characterized in that at least four basic colors can be used.

6. The method as claimed in claim 5, characterized by the basic colors red, green, blue and yellow.

7. The method as claimed in claim 5, characterized by the basic colors red, green, blue, yellow, black and white.

8. The method as claimed in claim 1, characterized in that the weaving program provides for the insertion of weft thread groups in a uniform order.

9. A plant for carrying out the method as claimed in claim 1, characterized in that it contains a CAD device.

10. The plant as claimed in claim 6, characterized in that it contains a weaving machine.

* * * * *